US006241476B1

(12) United States Patent
Lee

(10) Patent No.: US 6,241,476 B1
(45) Date of Patent: Jun. 5, 2001

(54) SECURING DEVICE

(75) Inventor: Kwing Wah Lee, Hong Kong (HK)

(73) Assignee: Using Co. Ltd., Kowloon (HK)

( * ) Notice: Subject to any disclaimer, the term of this patent is extended or adjusted under 35 U.S.C. 154(b) by 0 days.

(21) Appl. No.: 09/425,997

(22) Filed: Oct. 25, 1999

(51) Int. Cl.[7] ..... F04D 29/34
(52) U.S. Cl. ..... 416/210 R; 416/244 R
(58) Field of Search ..... 416/204 R, 204 A, 416/205, 206, 207, 244 R, 210 R

(56) References Cited

U.S. PATENT DOCUMENTS 5,951,197 * 9/1999 Wu ..... 416/206

* cited by examiner

*Primary Examiner*—F. Daniel Lopez
*Assistant Examiner*—James M. McAleenan
(74) *Attorney, Agent, or Firm*—Hall, Priddy, Myers & Vande Sande

(57) ABSTRACT

A securing device for securing an arm member with a fan blade is disclosed, in which the arm member includes screws receivable within apertures of the fan blade, in which the screws include a narrower portion which, when the screws are received within the apertures of the fan blade, extend beyond the apertures of the fan blade, in which when the screws of the arm member are received within the apertures of the fan blade, the securing device is movable relative to the arm member in a first direction to engage with the narrower portion of the respective screws, and in which the arm member includes a barrier for preventing the securing device from moving in a direction opposite to the first direction upon engagement of the securing device with the screws, and thereby to secure the arm member with the fan blade by the securing device.

22 Claims, 6 Drawing Sheets

FIG. 3A
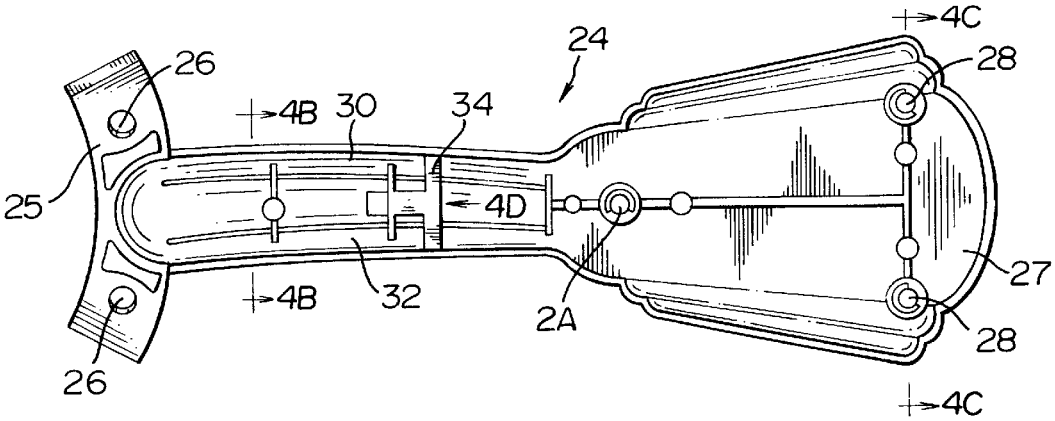
FIG. 3B
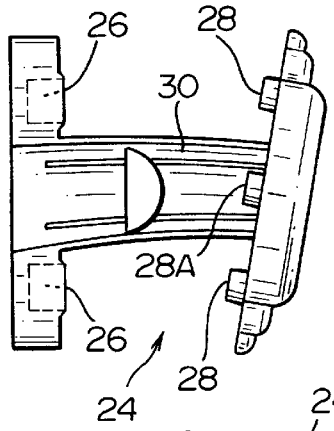
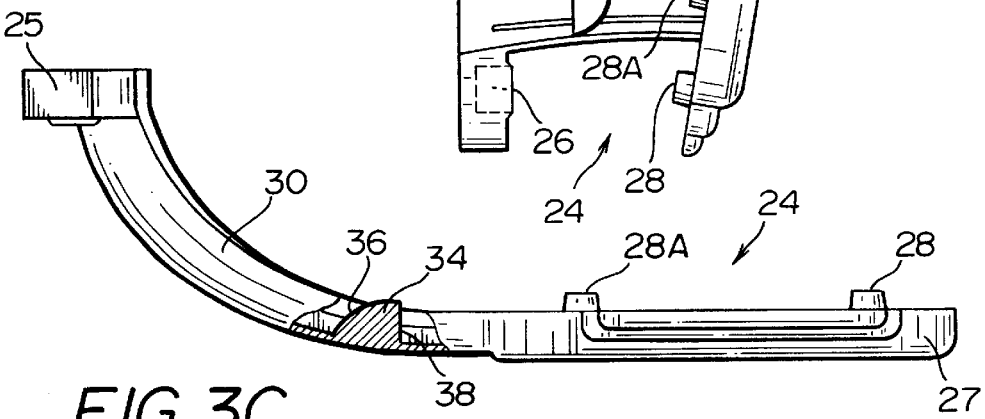
FIG. 3C
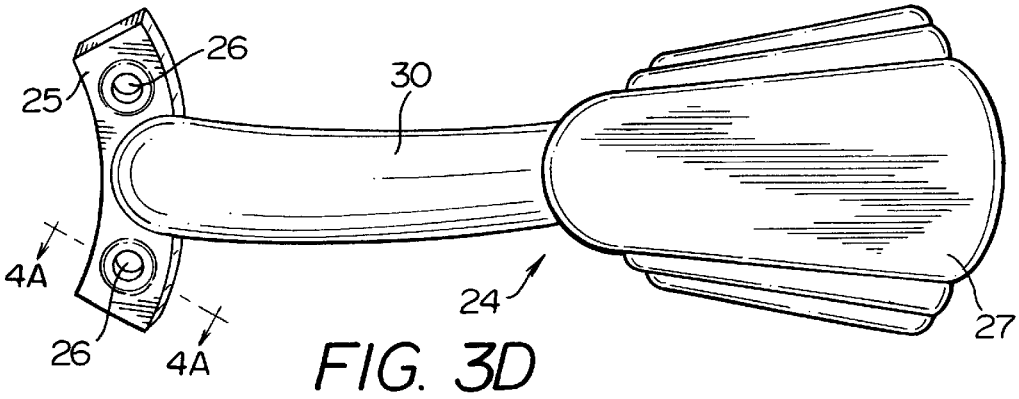
FIG. 3D

SECURING DEVICE

This invention relates to a securing device for securing two articles with each other. In particular, such a device is suitable for, but not limited to, securing a fan blade to a blade bracket which can in turn be secured to a rotational body of a ceiling fan.

BACKGROUND OF THE INVENTION

When end users purchase ceiling fans with relatively long fan blades, such are usually packaged in such a way that the blades are not secured to the rotation body. It is thus necessary for the purchaser or technician to perform a quite complicated and tedious assembling process before the blades can be secured to the rotational body.

It is thus an object of the invention to provide a securing device in which the above shortcoming is mitigated, or at least to provide a useful alternative to the public.

SUMMARY OF THE INVENTION

According to the present invention, there is provided a securing device for securing a first article with a second article, wherein said first article includes at least one male member receivable within an aperture of said second article, wherein said male member includes an engagement portion which, when said male member is received within said aperture of said second article, extends beyond said aperture of said second article, wherein when said male member of said first article is received within said aperture of said second article, said device is movable relative to said male member in a first direction to engage with said engagement portion of said male member, and wherein said first article includes means for preventing said device from moving in a direction substantially opposite to said first direction upon engagement of said device with said male member, and thereby to secure said first article with said second article by said device.

According to a second aspect of the present invention, there is provided a securing device for securing at least two articles together, wherein said device includes a head portion and at least two arm portions, wherein each of said arm portions includes an end with a respective recessed portion for engagement with at least one said article.

BRIEF DESCRIPTION OF THE DRAWINGS

An embodiment of the present invention will now be described by way of an example, and with reference to the accompanying drawings, wherein:

FIG. 3A shows a top view of an arm member according to the present invention;

FIG. 3B shows an end view of the arm member shown in FIG. 3A;

FIG. 3C shows a partially sectioned side view of the arm member shown in FIG. 3A;

FIG. 3D shows a bottom view of the arm member shown in FIG. 3A;

DETAILED DESCRIPTION OF THE PREFERRED EMBODIMENT

Figure 1A:
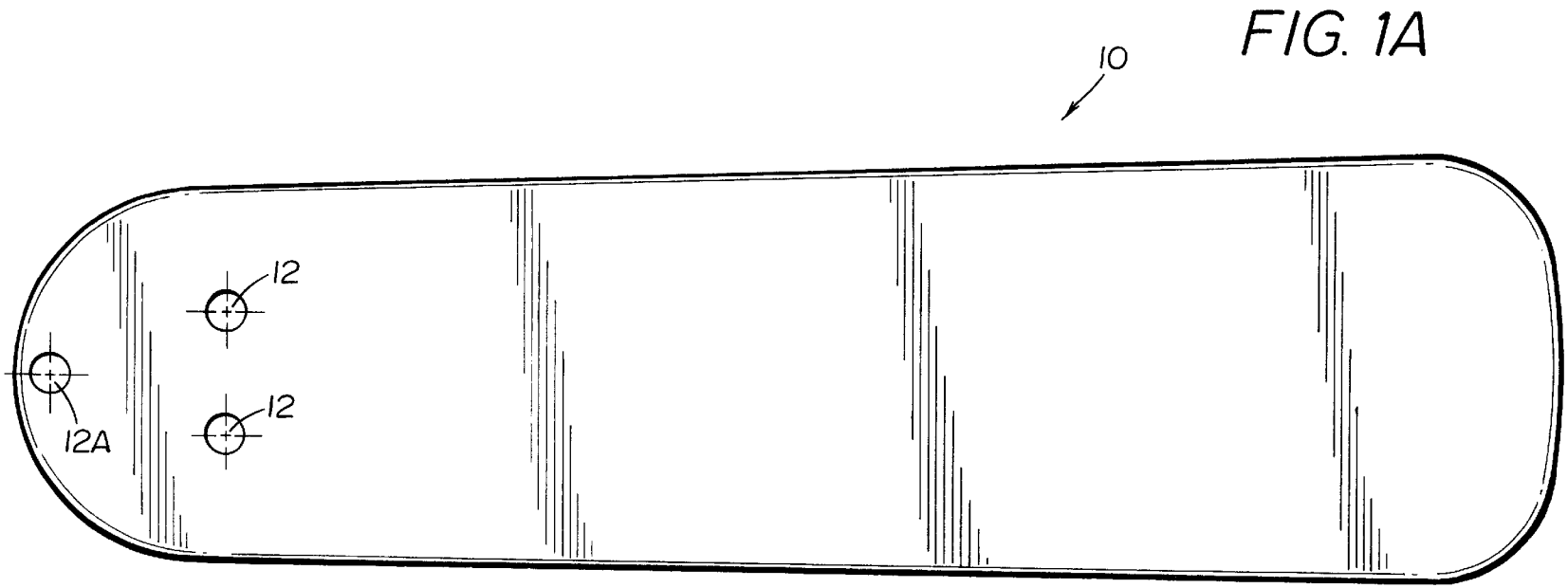
FIG. 1A shows a top view of a fan blade according to the present invention.
Figure 1B:
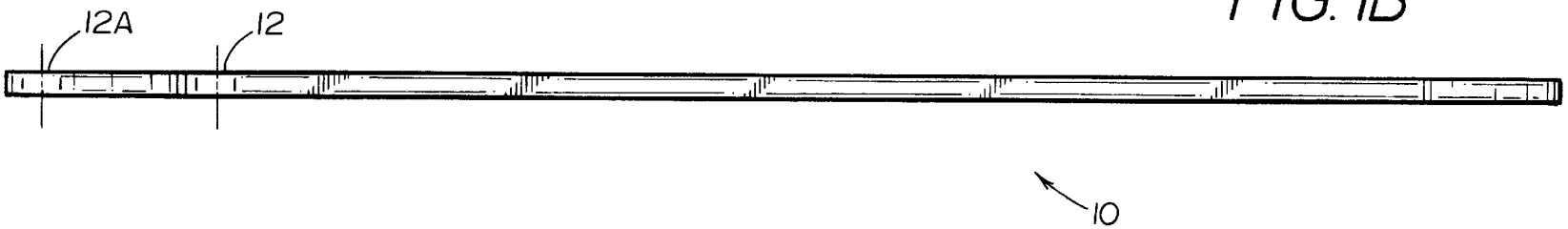
FIG. 1B shows a side view of the fan blade shown in FIG. 1A.
Figure 4C:
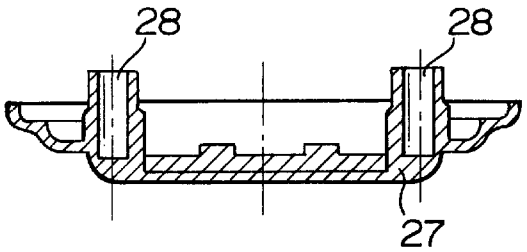
FIG. 4C shows a sectional view taken along the line C—C in FIG. 3A.
Figure 4D:
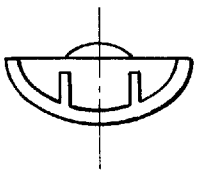
FIG. 4D shows a view of the arm member as viewed from the direction of the arrow D in FIG. 3A.
Figure 4A:
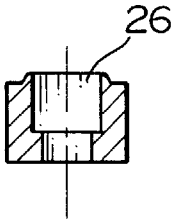
FIG. 4A shows a sectional view taken along the line A—A in FIG. 3D.
Figure 4B:
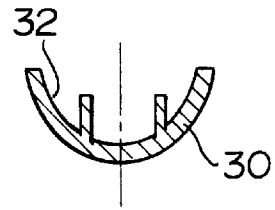
FIG. 4B shows a sectional view taken along the line B—B in FIG. 3A.

FIGS. 1A and 1B show a planar wooden fan blade generally designated as 10. Adjacent to one end of the blade 10 are provided three holes 12 and 12A, each for receiving a washer and a screw, to be discussed below.

Figure 2A:
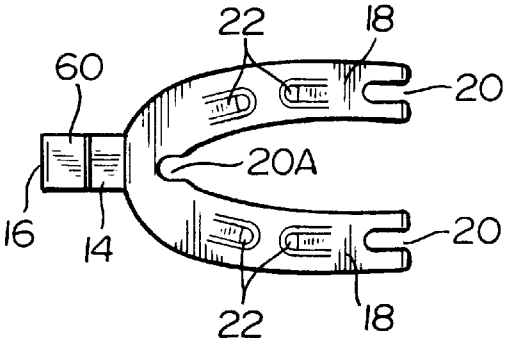
FIG. 2A shows a top view of a fork member according to the present invention.
Figure 2B:
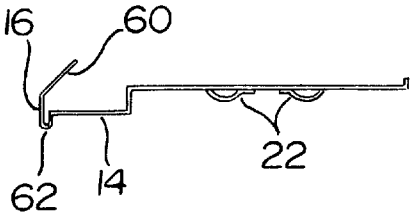
FIG. 2B shows a side view of the fork member shown in FIG. 2A.

FIGS. 2A and 2B show a fork member 14, which may preferably be made of a metal. At one end of the fork member 14 is a head portion 16. As the fork member 14 is relatively thin, it, and in particular the head portion 16, possesses a certain degree of resilience, which assists in working the present invention. Opposite to the head portion 16 are two fork arms 18. At the end of each fork arm 18 is provided a recess 20. Along each of the fork arms 18 is provided with two tongue members 22. At the portion where the two fork arms 18 join with each other, there is provided a third recess 20A. The functions of the recesses 20, 20A and the tongue members 22 will be discussed below.

FIGS. 3A to 3D show various views of an arm member, generally designated as 24, with an upper longitudinal end 25, and a lower longitudinal end 27, joined by a curved portion 30. Adjacent to the upper longitudinal end 25 are two threaded bore holes 26, through each of which a screw (not shown) may be received for securing the arm member 24 to a rotational body (not shown) of a ceiling fan (not shown). Provided adjacent to the lower longitudinal end 27 of the arm member 24 are three threaded holes 28 and 28A. The holes 28 and 28A are so positioned that they may be aligned with the holes 12 and 12A of the blade 10. For aesthetic reasons, the holes 28 and 28A do not, in this example, go through the entire thickness of the arm member 24. On an upper surface 32 of the curved portion 30 is provided a barrier 34. As can be seen more clearly in FIG. 3C, the barrier 34 includes a curved surface 36 facing towards the upper longitudinal end 25, and a vertical planar surface 38 facing towards the lower longitudinal end 27. FIGS. 4A to 4D show various views of the arm member 24.

Figure 5A:
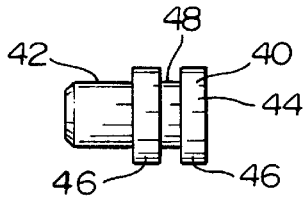
FIG. 5A shows a side view of a screw for use in the present invention.
Figure 5B:
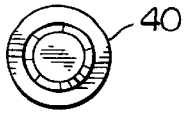
FIG. 5B shows an end view of the screw shown in FIG. 5A.

As to FIGS. 5A and SB, such show a screw 40 to be threadedly engaged with the threaded holes 28 and 28A of the arm member 24. Each screw 40 includes a threaded portion 42 for threaded engagement with the internal thread of the holes 28 and 28A. Each of the screws 40 also includes a head portion 44 with two wider sections 46 and an intermediate narrower section 48 joining the two wider sections 46. The screws 40 are each formed integrally.

Figure 6A:
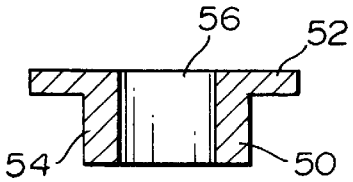
FIG. 6A shows a longitudinal sectional view of a plastics washer for use in the present invention.
Figure 6B:
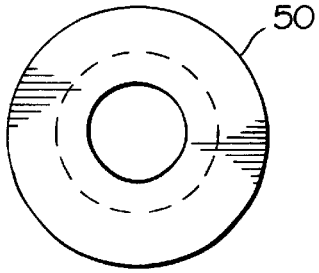
FIG. 6B shows a top view of the washer shown in FIG. 6A.

FIGS. 6A and 6B show views of a plastics washer 50 with a circular thinner wider section 52 and a thicker narrower section 54 formed integrally with each other. There is also provided a through hole 56 extending along the longitudinal axis of the washer 50.

Figure 7A:
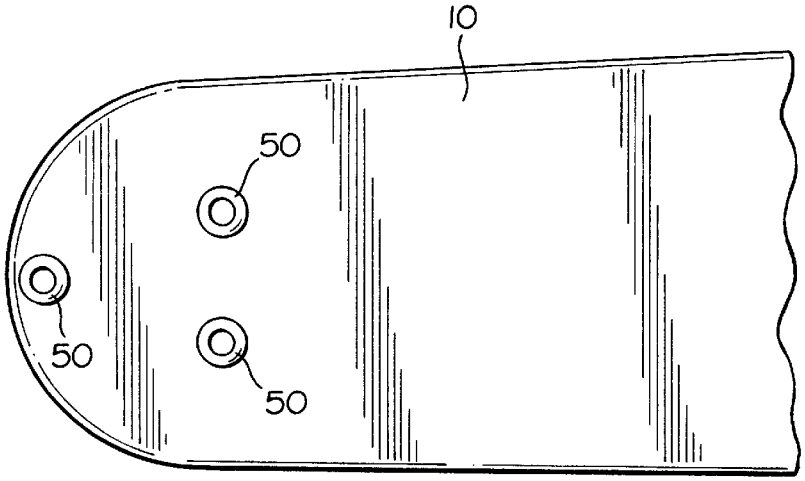
FIG. 7A shows a partial top view of the fan blade shown in FIG. 1A as engaged with plastics washers as shown in FIGS. 6A and 6B.
Figure 7B:
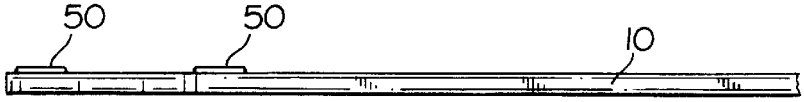
FIG. 7B shows a side view of the fan blade and plastics washers shown in FIG. 7A.

The narrower section 54 of the washer 50 is sized for being received within one of the holes 12, 12A of the blade 10. On the other hand, the wider section 52 of the washer 50 is wider than the holes 12, 12A so that, when the washers 50 are received within the holes 12, 12A, the respective wider section 52 will rest on the upper surface of the blade 10, as can be seen in FIGS. 7A and 7B.

Figure 8A:
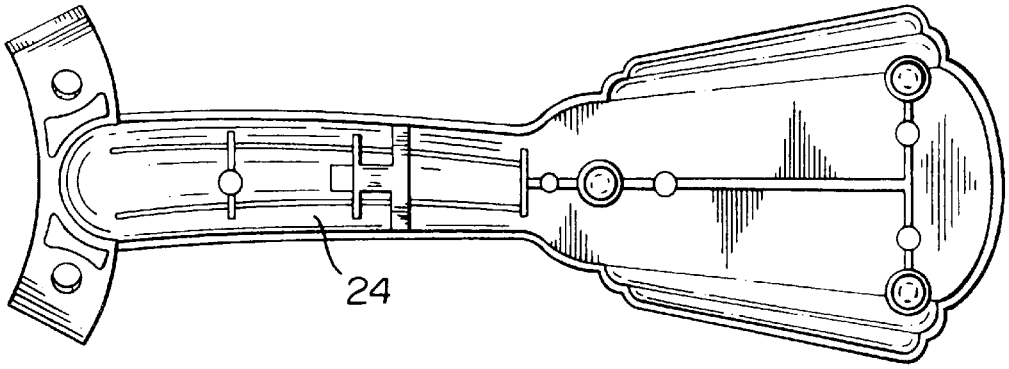
FIG. 8A shows a top view of the arm member shown in FIG. 3A as engaged with screws as shown in FIGS. 5A and 5B.
Figure 8B:
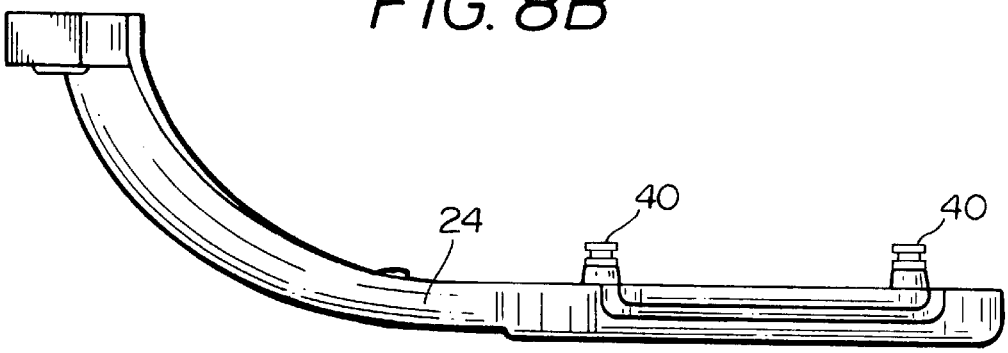
FIG. 8B shows a side view of the arm member and screws shown in FIG. 8A.

In addition, as shown in FIGS. 8A and 8B, when the screws 40 are threadedly engaged with the thread holes 28, 28A of the lower longitudinal end 27 of the arm member 24, the respective narrower section 48 of the screws 40 extends above the thread holes 28, 28A. It should also be noted that the diameter of the through hole 56 of the washer 50 and the outer diameter of the wider section 46 of the head portion 44 of the screw 40 are such that the screw 40 may be received thorough the through hole 56.

Figure 9A:
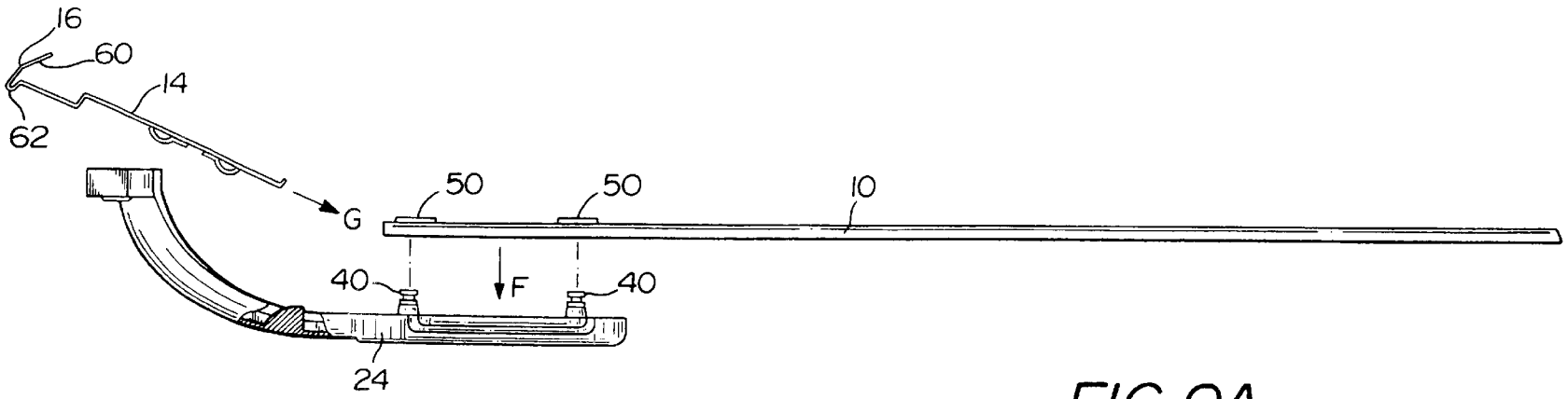
FIG. 9A shows the manner of securing the fan blade, arm member and fork member with one another according to the present invention.

When a ceiling fan incorporating the present invention is provided to the end users, the screws 40 are already threadedly engaged with the threaded holes 28, 28A of the lower longitudinal end 27 of the arm member 24. For assembly, the technician/end user is first to engage the washers 50 with the holes 12, 12A of the blades 10, as shown in FIGS. 7A and 7B. The blade 10 is then engaged with the arm member 24 by moving relative to the blade 10 in the direction indicated by the arrow F, and as shown in FIG. 9A, so that the screws 40 are received within the through holes 56 of the washers 50. When the blade 10 and the arm member 24 are so engaged, the narrower section 48 of the head portion 44 of the screws 40 will extend above the wider section 52 of the washers 50.

To secure the blade 10 to the arm member 24, the fork member 14 is to move relative to the blade 10 in the direction indicated by the arrow G. During such a movement, the resilient head portion 16 of the fork member 14 will ride on the curved surface 36 of the barrier 34 of the arm member 24. However, once the head portion 16 passes over the vertical planar surface 38 of the barrier 34, the recesses 20 of the fork arms 18 will be engaged with the narrower section 48 of the head portion 44 of the screws 40 which extend through the holes 12 of the blade 10, and the recess 20A of the fork member 14 will also be engaged with narrower section 48 of the head portion 44 of the screw 40 which extends through the hole 12A of the blade 10. In this position, and as shown in FIG. 9B, the fork member 14 is prevented from moving relative to the blade 10 in the direction indicated by the arrow H, which is opposite to the direction indicated by the arrow G, by reason of the vertical planar surface 38 of the barrier 34, with which the head portion 16 of the fork member 14 is in contact.

Figure 9B:
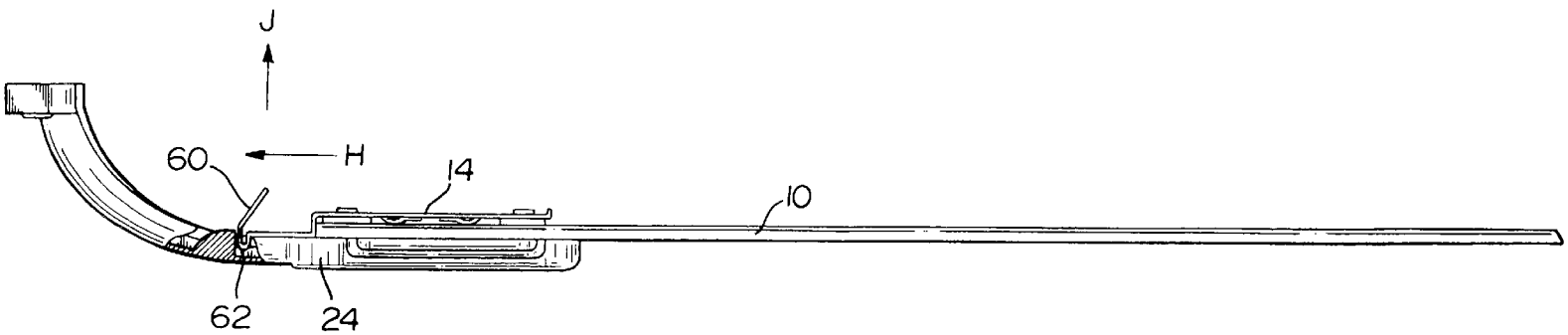
FIG. 9B shows the fan blade, arm member and fork member as secured with one another according to the present invention.

It can also be seen in FIG. 9B that, when the blade 10 is secured to the arm member 24, the tongue members 22 of the fork arms 18 abut the upper surface of the blade 10. Because of the resilience of the tongue members 22, they are biased towards the upper surface of the blade 10. Such enhances the securing action of the fork member 14 upon the blade 10.

By way of such an arrangement, the end user/technician can secure the blade 10 to the arm member 24 in a safe and easy manner.

If necessary, it is also possible to disengage the fork member 14 from the blade 10 and the arm member 24. As can be seen in FIGS. 2A, 2B, 9A and 9B, the fork member 14 also includes a lip portion 60 and a U-shaped part 62 at its head portion 16. When the fork member 14, the blade 10 and the arm member 24 are assembled as shown in FIG. 9B, a user may pull the lip portion 60 upward substantially in the direction indicated by the arrow J. When the U-shaped part 62 is pulled above the vertical planar surface 38 of the barrier 34, the fork member 14 may then move in the direction indicated by the arrow H, so as to be disengaged from the screws 40, and thus the blade 10 and the arm member 24.

What is claimed is:

1. A securing device for securing a first article with a second article, wherein said first article includes at least one male member receivable within an aperture of said second article, wherein said male member includes an engagement portion which, when said male member is received within said aperture of said second article, extends beyond said aperture of said second article, wherein when said male member of said first article is received within said aperture of said second article, and wherein said first article includes means for preventing said device from moving in a direction substantially opposite to said first direction upon engagement of said device with said male member, and thereby to secure said first article with said second article by said device.

2. A device according to claim 1 wherein said male member is releasably engageable with said first article.

3. A device according to claim 2 wherein said male member is threadedly engageable with said first article.

4. A device according to claim 1 wherein at least part of said device abuts a surface of said second article when said device is engaged with said male member.

5. A device according to claim 4 wherein said device includes at least one resilient member which abuts said surface when said device is engaged with said male member.

6. A device according to claim 5 wherein said resilient member is biased towards said surface when said device is engaged with said male member.

7. A device according to claim 1 wherein said device includes an end with a resilient tab.

8. A device according to claim 7 wherein said resilient tab is adapted to contact said preventing means when said device is engaged with said male member of said first article.

9. A device according to claim 1 wherein said first article includes at least two male members.

10. A device according to claim 9 wherein said device includes two arm members each for engaging with one of said male members.

11. A device according to claim 9 wherein said second article includes at least two apertures each for receiving therethrough one of said male members.

12. A device according to claim 9 wherein said first article includes at least three male members.

13. A device according to claim 12 wherein said device includes two arm members each for engaging with one of said male members, and wherein the portion where said two arm members join is adapted to engage with the third male member.

14. A device according to claim 12 wherein said second article includes at least three apertures each for receiving therethrough one of said male members.

15. A device according to claims 1 wherein said second article comprises a fan blade.

16. A device according to claim 1 wherein said first article is adapted to be secured to a rotation body of a fan.

17. A securing device for securing at least two articles together, wherein said device includes a head portion and at least two arm portions, wherein each of said arm portions includes an end with a respective recessed portion for engagement with at least one said article.

18. A device according to claim 17 wherein the location where said arm portions join includes a third recessed portion for engagement with at least one said article.

19. A device according to claim 17 wherein at least one said arm portion includes at least one resilient member adapted to abut at least one said article.

20. A device according to claim 19 wherein at least one said arm portion includes at least two said resilient members.

21. A device according to claim 17 wherein each of said arm portions includes at least two said resilient members.

22. A device according to claim 17 wherein said head portion includes a lip member operable to move the head portion.

* * * * *